US005966756A

United States Patent [19]

Cartier

[11] Patent Number: 5,966,756

[45] Date of Patent: Oct. 19, 1999

[54] CONVERTIBLE SLEEPING BAG

[76] Inventor: Gary R. Cartier, 33 Sharren La., Enfield, Conn. 06082

[21] Appl. No.: 09/001,445

[22] Filed: Dec. 31, 1997

[51] Int. Cl.[6] ..... A47G 9/08

[52] U.S. Cl. ..... 5/413 R; 5/502; 2/69.5

[58] Field of Search ..... 5/413 R, 413 AM, 5/487, 502; 2/69.5

[56] References Cited

U.S. PATENT DOCUMENTS

| | | | |
|---|---|---|---|
| 3,178,734 | 4/1965 | Carrez | 5/413 R |
| 4,087,874 | 5/1978 | Callaway et al. | 5/413 R |
| 4,601,076 | 7/1986 | Knobeloch | 5/413 R |
| 5,005,235 | 4/1991 | Huang | 5/413 R |
| 5,735,003 | 4/1998 | Judge | 5/413 AM |

FOREIGN PATENT DOCUMENTS

| | | | |
|---|---|---|---|
| 883921 | 12/1961 | United Kingdom | 5/413 R |

*Primary Examiner*—Michael F. Trettel

[57] ABSTRACT

A new convertible sleeping bag for allowing extra insulation to be added for providing added warmth and comfort. The inventive device includes an enclosure comprising a front panel and a rear panel. The front panel and the rear panel are affixed together along a first side edge and a bottom edge and a lower segment of a second side thereof with an upper segment of the second side edge and a top edge of the panels coupled together by a zipper. An interior pocket is secured to an interior surface of the rear panel of the enclosure. The interior pocket has an open upper end for receiving insulating material therein.

8 Claims, 2 Drawing Sheets

CONVERTIBLE SLEEPING BAG

BACKGROUND OF THE INVENTION

1. Field of the Invention

The present invention relates to sleeping bags and more particularly pertains to a new convertible sleeping bag for allowing extra insulation to be added for providing added warmth and comfort.

2. Description of the Prior Art

The use of sleeping bags is known in the prior art. More specifically, sleeping bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art sleeping bags include U.S. Pat. No. 4,884,303 to Scherer; U.S. Pat. No. 4,354,281 to Satoh; U.S. Pat. No. 3,959,834 to Hunt; U.S. Pat. No. 4,888,828 to Tatsuno; U.S. Pat. No. 4,575,884 to Jamerson et al.; and U.S. Pat. No. Des. 348,348 to Lawson.

While these devices fulfill their respective, particular objectives and requirements, the aforementioned patents do not disclose a new convertible sleeping bag. The inventive device includes an enclosure comprising a front panel and a rear panel. The front panel and the rear panel are affixed together along a first side edge and a bottom edge and a lower segment of a second side thereof with an upper segment of the second side edge and a top edge of the panels coupled together by a zipper. An interior pocket is secured to an interior surface of the rear panel of the enclosure. The interior pocket has an open upper end for receiving insulating material therein.

In these respects, the convertible sleeping bag according to the present invention substantially departs from the conventional concepts and designs of the prior art, and in so doing provides an apparatus primarily developed for the purpose of allowing extra insulation to be added for providing added warmth and comfort.

SUMMARY OF THE INVENTION

In view of the foregoing disadvantages inherent in the known types of sleeping bags now present in the prior art, the present invention provides a new convertible sleeping bag construction wherein the same can be utilized for allowing extra insulation to be added for providing added warmth and comfort.

The general purpose of the present invention, which will be described subsequently in greater detail, is to provide a new convertible sleeping bag apparatus and method which has many of the advantages of the sleeping bags mentioned heretofore and many novel features that result in a new convertible sleeping bag which is not anticipated, rendered obvious, suggested, or even implied by any of the prior art sleeping bags, either alone or in any combination thereof.

To attain this, the present invention generally comprises an enclosure comprising a front panel and a rear panel. The front panel and the rear panel are affixed together along a first side edge and a bottom edge and a lower segment of a second side thereof with an upper segment of the second side edge and a top edge of the panels coupled together by a zipper closure. The front panel is comprised of a top layer and a bottom layer with insulation disposed therebetween. The top edge has a drawstring disposed therein for selectively locking the enclosure. An interior pocket is secured to an interior surface of the rear panel of the enclosure. The interior pocket has an open upper end for receiving insulating material therein. A plurality of support bands are secured to an exterior surface of the rear panel of the enclosure in a spaced relationship. A foam padding support is dimensioned for being received within the plurality of support bands.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new convertible sleeping bag apparatus and method which has many of the advantages of the sleeping bags mentioned heretofore and many novel features that result in a new convertible sleeping bag which is not anticipated, rendered obvious, suggested, or even implied by any of the prior art sleeping bags, either alone or in any combination thereof.

It is another object of the present invention to provide a new convertible sleeping bag which may be easily and efficiently manufactured and marketed.

It is a further object of the present invention to provide a new convertible sleeping bag which is of a durable and reliable construction.

An even further object of the present invention is to provide a new convertible sleeping bag which is susceptible of a low cost of manufacture with regard to both materials and labor, and which accordingly is then susceptible of low prices of sale to the consuming public, thereby making such convertible sleeping bag economically available to the buying public.

Still yet another object of the present invention is to provide a new convertible sleeping bag which provides in the apparatuses and methods of the prior art some of the advantages thereof, while simultaneously overcoming some of the disadvantages normally associated therewith.

Still another object of the present invention is to provide a new convertible sleeping bag for allowing extra insulation to be added for providing added warmth and comfort.

Yet another object of the present invention is to provide a new convertible sleeping bag which includes an enclosure comprising a front panel and a rear panel. The front panel and the rear panel are affixed together along a first side edge and a bottom edge and a lower segment of a second side thereof with an upper segment of the second side edge and a top edge of the panels coupled together by a zipper. An interior pocket is secured to an interior surface of the rear panel of the enclosure. The interior pocket has an open upper end for receiving insulating material therein.

Still yet another object of the present invention is to provide a new convertible sleeping bag that is light in weight yet as warm and comfortable as a heavier sleeping bag.

Even still another object of the present invention is to provide a new convertible sleeping bag that is designed without insulation on the bottom surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
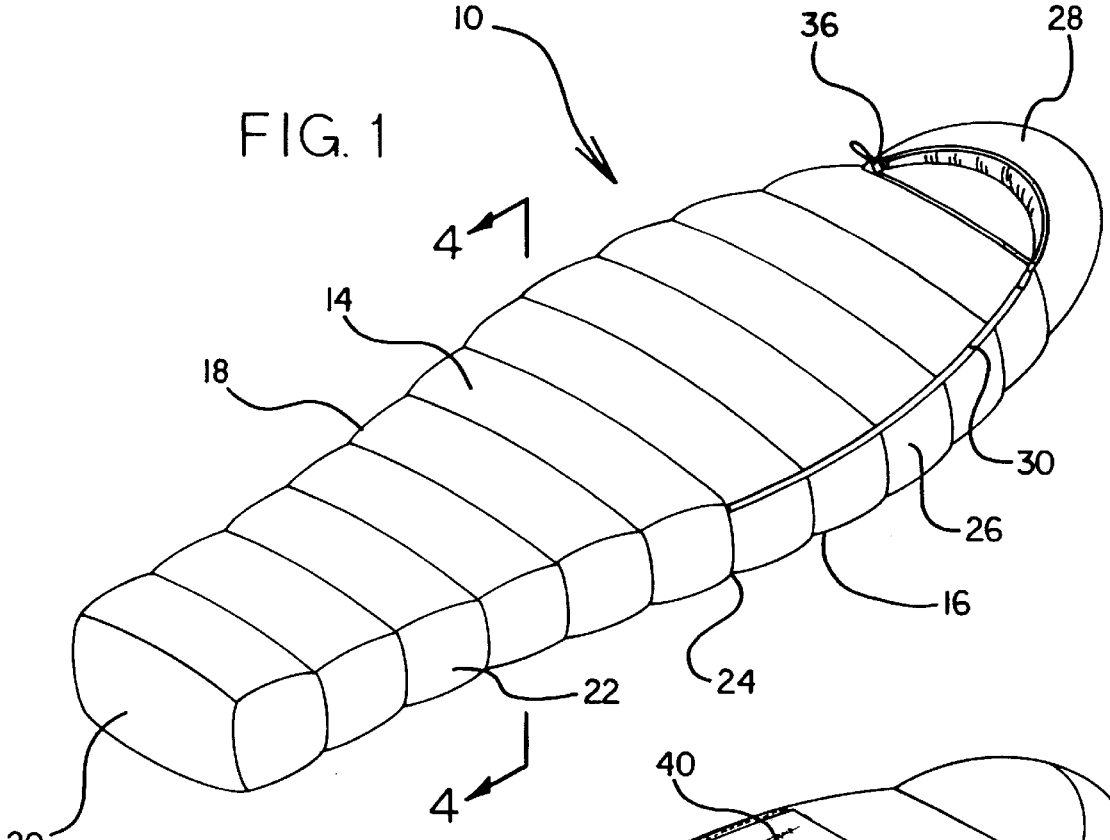
FIG. 1 is a top perspective view of a new convertible sleeping bag according to the present invention.

With reference now to the drawings, and in particular to FIGS. 1 through 4 thereof, a new convertible sleeping bag embodying the principles and concepts of the present invention and generally designated by the reference numeral 10 will be described.

As best illustrated in FIGS. 1 through 4, the convertible sleeping bag 10 comprises an enclosure 12 comprising a front panel 14 and a rear panel 16. The front panel 14 and the rear panel 16 are affixed together along a first side edge 18 and a bottom edge 20 and a lower segment 22 of a second side 24 thereof with an upper segment 26 of the second side edge 24 and a top edge 28 of the panels coupled together by a zipper closure 30. The front panel 14 is comprised of a top layer 30 and a bottom layer 32 with insulation 34 disposed therebetween. The top edge 28 has a drawstring 36 disposed therein for selectively locking the enclosure 12.

An interior pocket 38 is secured to an interior surface of the rear panel 16 of the enclosure 12. The interior pocket 38 has an open upper end for receiving insulating material therein. The interior support pocket 38 is formed by upper and lower bands each having a width between six and eight inches.

Figure 2:
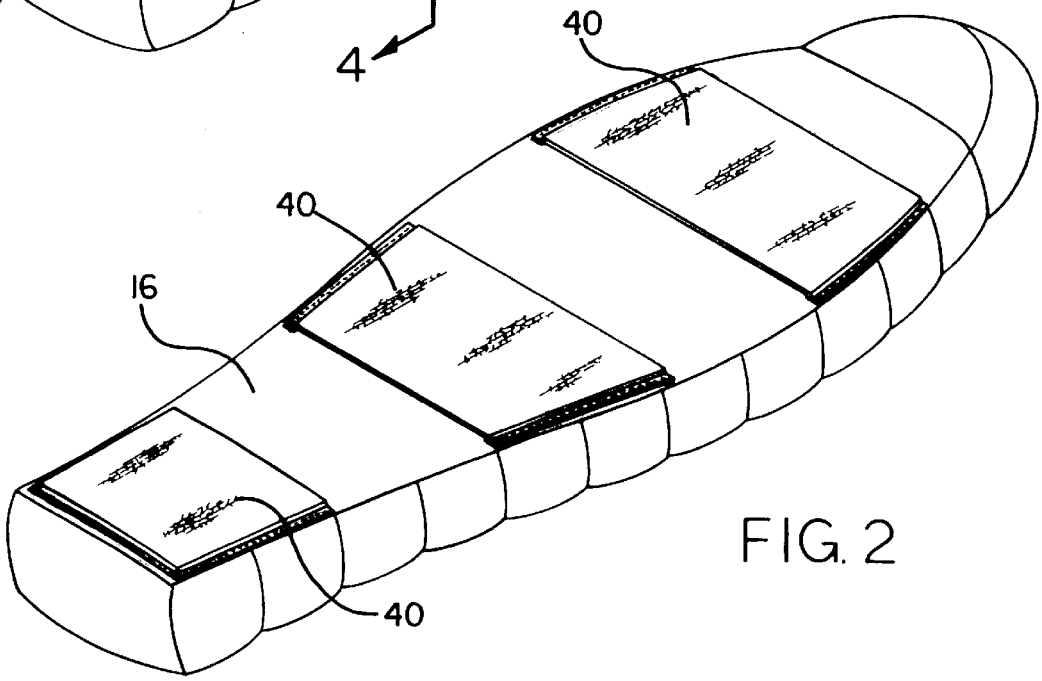
FIG. 2 is a bottom perspective view of the present invention.
Figure 3:
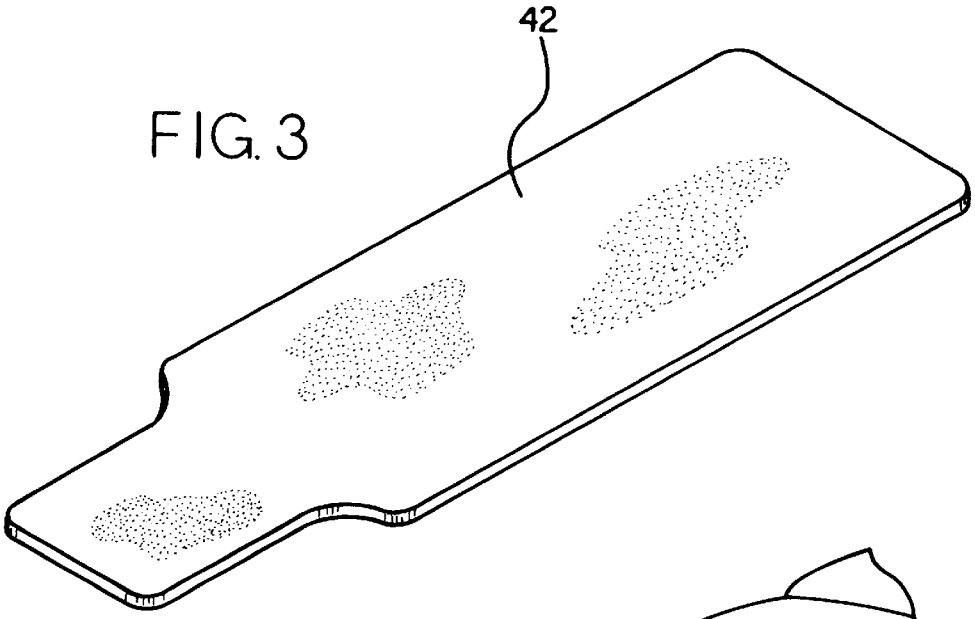
FIG. 3 is a perspective view of the foam padding insert of the present invention.
Figure 4:
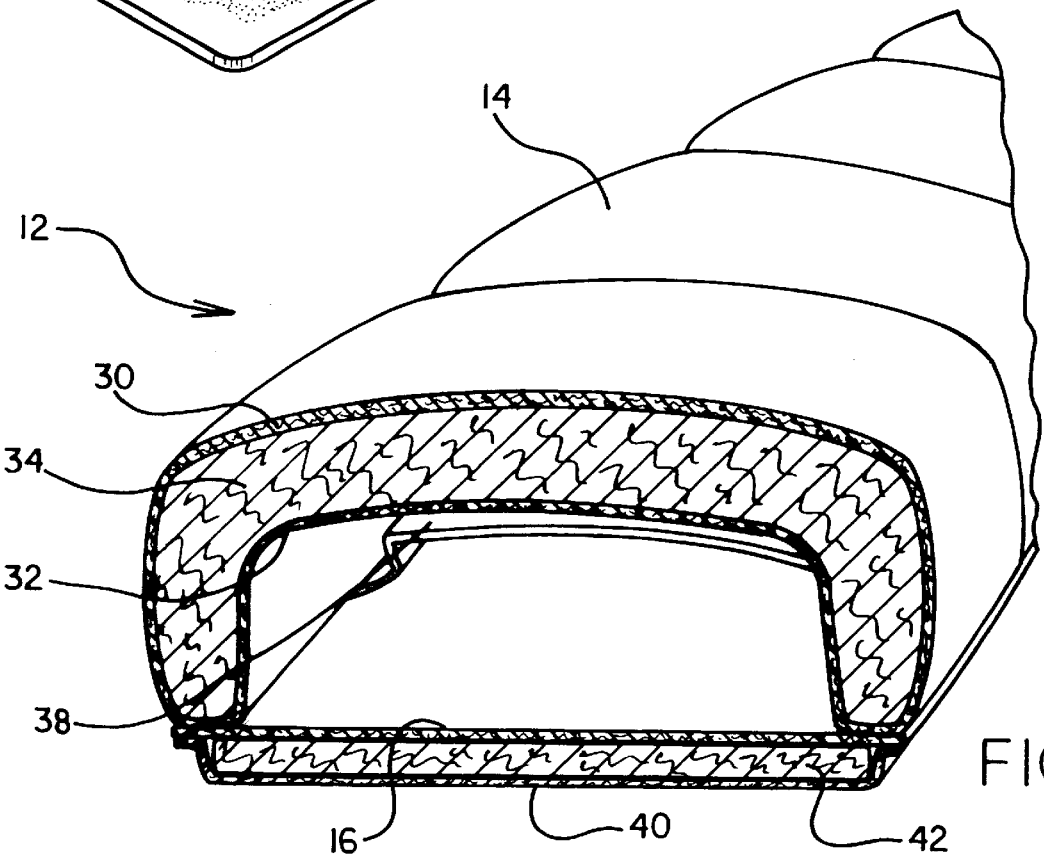
FIG. 4 is a cross-sectional view of the present invention as taken along line 4—4 of FIG. 1.

A plurality of support bands 40 are secured to an exterior surface of the rear panel 16 of the enclosure 12 in a spaced relationship. In the preferred embodiment, three support bands 40 are provided as illustrated in FIG. 2.

A foam padding support 42 is dimensioned for being received within the plurality of support bands 40. The foam padding support 42 is used to provide a padded lower surface when needed, especially in the outdoors.

The present invention is a mummy-style sleeping bag designed with no insulating fill in the rear panel 16 of the enclosure 12. The reason for not placing insulation in the rear panel 16 is that once the insulation is compressed, it loses effectiveness. Instead, the interior pocket 38 is provided to receive insulation material or clothing so as to insulate the enclosure 12 when in use. Two types of enclosures 12 can be provided. A first type is designed to be the lightest possible and fabricated of nylon. A second type is softer but slightly heavier and is fabricated of a Suplex material. The enclosures 12 can be produced in a variety of sizes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A convertible sleeping bag for allowing extra insulation to be added for providing added warmth and comfort, comprising:

an enclosure comprising a front panel and a rear panel, the front panel and the rear panel being affixed together along a first side edge and a bottom edge and a lower segment of a second side thereof with an upper segment of the second side edge and a top edge of the panels being coupled together by a zipper closure, the front panel being comprised of a top layer and a bottom layer with insulation disposed therebetween, the top edge having a drawstring disposed therein for selectively locking the enclosure;

wherein the top edge is rounded for minimizing surface area for reducing heat loss;

a length of the enclosure being defined between the top and bottom edges of the enclosure:

an interior pocket secured to an interior surface of the rear panel of the enclosure, the interior pocket having an open upper end for receiving insulating material therein, the interior pocket being positioned towards the bottom edge of the enclosure for holding insulation material towards legs of a user;

a plurality of support bands secured to an exterior surface of the rear panel of the enclosure in a spaced relationship;

each of the support bands having top and bottom ends extending between the side edges of the rear panel, and opposite side ends extending between the top and bottom ends, a width of each of the support bands defined between the ends of the associated support band, wherein the width of each of the support bands is greater than about ⅛ of said length of the enclosure;

a foam padding support dimensioned for being received within the plurality of support bands, the foam padding support having substantially straight side edges; and the side ends of a central pair of support bands being diagonally fastened to the rear panel such that the side ends of each of the pair of support bands taper outwardly towards the other of the pair of support bands for permitting limited lateral movement of a central portion of the enclosure positioned between outer ends of the pair of support bands.

2. A convertible sleeping bag comprising:

an enclosure comprising a front panel and a rear panel, the front panel and the rear panel being affixed together along a first side edge and a bottom edge and a lower segment of a second side thereof with an upper segment of the second side edge and a top edge of the panels being coupled together by a zipper, wherein the top edge is rounded for minimizing surface area for reducing heat loss; and an interior pocket secured to an interior surface of the rear panel of the enclosure, the interior pocket having an open upper end for receiving insulating material therein, the interior pocket being positioned towards the bottom edge of the enclosure for holding insulation material towards legs of a user.

3. The convertible sleeping bag as set forth in claim 2 wherein the front panel of the enclosure is comprised of a top layer and a bottom layer with insulation disposed therebetween.

4. The convertible sleeping bag as set forth in claim 2 wherein the top edge of the enclosure has a drawstring disposed therein for selectively locking the enclosure.

5. The convertible sleeping bag as set forth in claim 2 and further including a plurality of support bands secured to an exterior surface of the rear panel of the enclosure in a spaced relationship.

6. The convertible sleeping bag as set forth in claim 5 and further including a foam padding support dimensioned for being received within the plurality of support bands.

7. The convertible sleeping bag as set forth in claim 5 wherein a length of the enclosure is defined between the top and bottom edges of the enclosure, each of the support bands having top and bottom ends extending between the side edges of the rear panel, and opposite side ends extending between the top and bottom ends, a width of each of the support bands defined between the ends of the associated support band, wherein the width of each of the support bands is greater than about ⅛ of said length of the enclosure.

8. The convertible sleeping bag as set forth in claim 6 wherein the foam padding support has substantially straight side edges, the side ends of a central pair of support bands being diagonally fastened to the rear panel such that the side ends of each of the pair of support bands taper outwardly towards the other of the pair of support bands for permitting limited lateral movement of a central portion of the enclosure positioned between outer ends of the pair of support bands.

* * * * *